United States Patent [19]

Veyhl et al.

[11] Patent Number: 5,036,776

[45] Date of Patent: Aug. 6, 1991

[54] TABLE WITH ADJUSTABLE TABLE TOP

[75] Inventors: Wolf Veyhl; Erwin Kübler, both of Neuweiler, Fed. Rep. of Germany

[73] Assignee: Veyhl GmbH & Co., Fed. Rep. of Germany

[21] Appl. No.: 433,559

[22] Filed: Nov. 8, 1989

[30] Foreign Application Priority Data

Nov. 16, 1988 [DE] Fed. Rep. of Germany ..... 3838763

[51] Int. Cl.[5] ..... A47F 5/12

[52] U.S. Cl. ..... 108/7; 108/148

[58] Field of Search ..... 108/1, 6, 7, 8, 148; 248/372.1, 371.393

[56] References Cited

U.S. PATENT DOCUMENTS

| | | | |
|---|---|---|---|
| 120,604 | 11/1871 | Wibbert | 108/6 |
| 841,766 | 1/1907 | Campbell | 108/6 X |
| 945,280 | 1/1910 | Lindberg | 108/6 X |
| 4,047,774 | 9/1977 | Hanning | 108/8 X |
| 4,437,411 | 3/1984 | Maxwell | 108/1 |
| 4,502,393 | 3/1985 | Kaiser | 108/1 |
| 4,553,483 | 11/1985 | Vottesler et al. | 108/1 X |
| 4,664,039 | 5/1987 | Schneider | 108/6 |
| 4,781,126 | 11/1988 | Lochridge | 108/6 |
| 4,785,742 | 11/1988 | Esslinger | 108/6 |

FOREIGN PATENT DOCUMENTS

| | | | |
|---|---|---|---|
| 36134 | 4/1967 | Finland | 108/1 |
| 1983 | of 1907 | United Kingdom | 108/7 |
| 585196 | 1/1947 | United Kingdom | 248/393 |

*Primary Examiner*—Jose V. Chen

*Attorney, Agent, or Firm*—Griffin Branigan & Butler

[57] ABSTRACT

An adjustable table top (7, 105) is supported movably on a trestle having at least one abutment (5, 104) fixed thereto beneath the table top. The abutment coacts with a wedge-shaped intermediate piece (9, 106) which is displacable in an opening direction of its wedge angle, substantially parallel to the table top, and which can be introduced to a lesser or greater extent into a space between the abutment and the table top so that a distance between the table top and the abutment and, thus, the position of the table top relative to the trestle, are determined by the position of the intermediate piece.

26 Claims, 5 Drawing Sheets

TABLE WITH ADJUSTABLE TABLE TOP

BACKGROUND OF THE INVENTION

The present invention relates to a table comprising a trestle, a table top supported movably by the trestle, and a device for adjusting the height of the table top, at least at one edge thereof, relative to the trestle.

Tables with table tops that can be adjusted as regards their height and/or their inclination have been previously known in various forms. Such a table with a table top that can be adjusted in height, provides the possibility of adapting the height of the table top to particular requirements of a person using the table, while a table equipped with a table top whose inclination can be adjusted provides the possibility of bringing a normally horizontal table top into a more convenient inclined position for writing or drawing purposes. Except for tables equipped with relatively expensive mechanical drive mechanisms for table-top adjustments, these tables are normally equipped with snap-in locking devices which are troublesome to operate, and this often prevents users from making practical use of such adjusting facilities.

Now, it is an object of the present invention to provide a table of the type described above in which adjustment of a table top is not connected with troublesome maneuvers, while on the other hand a device for adjusting the height or the inclination of the table top does not require great input, and/or particularly complex drive mechanisms. At the same time, the invention is directed to ensuring a secure fixing of the table top in a desired position.

This object is achieved according to the invention by the fact that at least one abutment is fixed to the trestle beneath the table top which coacts with a wedge-shaped intermediate piece which is arranged for being displaced in an opening direction of its angle, substantially parallel to the table top, and which can be introduced in this way a lesser or greater distance into a space between the abutment and the table top so that the distance between the table top and the abutment and, thus, the position of the table top relative to the trestle, are determined by the position of the intermediate piece.

The table top of the table according to the invention, therefore, is fixed in the selected position by the wedge-shaped intermediate piece which retains it, as a function of its selected position, at a defined distance from an abutment fastened to the trestle. The intermediate piece may also assume a position in which the table top rests directly on the abutment, in which case the distance between the table top and the abutment defined by the intermediate piece is equal to zero so that the lowest position of the table top is defined by the abutment.

Arranging a wedge-shaped intermediate piece does not present any difficulties. Simple guide devices will suffice for holding the intermediate piece, because such guide devices need not absorb any notable forces, the pressure being transmitted simply for the table top via the intermediate piece to the abutment fixed to the trestle. Although the table top rests on the intermediate piece, and the latter rests on the abutment substantially loosely, the table top is still retained safely in the selected position, being always loaded from above so that it will be sufficient to support it solidly from below. These requirements are absolutely fulfilled by the use of an abutment which supports the table top directly, or indirectly via the intermediate piece. When the table top is in an unloaded condition, the intermediate piece may be introduced, as desired, a lesser or greater distance, or degree, between the table top and the abutment. This makes handling of the table extremely simple. The intermediate piece may be mounted selectively either on the table top or on the trestle, and there are many different possibilities of supporting such an intermediate piece in movable relationship so that it can be introduced into, or withdrawn from the space between the table top and the abutment as desired. In the simplest of all cases the wedge-shaped intermediate piece may be mounted at the end of a pusher rod which provides a user with simple means for moving the intermediate piece by means of the pusher rod. Such a pusher rod would also make it possible to interconnect several such wedge-type intermediate pieces, for common operation. Such an arrangement would be particularly desirable in cases where parallel raising or lowering of the table top is desired, by means of several abutments and intermediate pieces arranged on an edge of the table top.

In the simplest of all cases, a table designed according to the invention may comprise a table top arranged for assuming, selectively, one of two defined positions, i.e. a lower position in which the table top rests directly on the abutment, or an upper position in which the wedge-shaped intermediate piece has been fully inserted into the space between the abutment and the table top. On the other hand, a particular advantage of the wedge shape is that it enables the position of the table top to be varied in small steps, or even infinitely, by varying the position of the wedge relative to the abutment.

In order to ensure efficient power transmission between the wedge-shaped intermediate piece and the adjoining components, the contact surface should be as large as possible. According to one preferred embodiment of the invention, therefore, the wedge-shaped intermediate piece comprises a first wedge surface extending in parallel to the direction of displacement and a second wedge surface extending at an angle relative to the first wedge surface, the second wedge surface being in contact with an oblique surface extending in parallel thereto, in at least one defined position of the table top. In the case of this embodiment of the invention, the first wedge surface forms a plane contact surface for a counterface extending in parallel to the direction of displacement, while the second wedge surface also comes into full surface contact with an oblique surface extending in parallel to the second wedge surface and provided specifically for this purpose. It is not necessary in this case that the second wedge surface and the mating oblique surface be absolutely planes. Rather, they may advantageously be designed as cylindrical surfaces whose generating lines extend in parallel to the legs of the wedge angle so that one obtains a formlocking engagement, in transverse direction to the direction of displacement of the intermediate piece, which does away with a need to secure the table top on the trestle against displacement in a direction perpendicular to the direction of movement of the intermediate piece. The wedge surface and the mating oblique surface may, preferably, be designed as circular cylindrical surfaces of substantially equal radii.

As has been mentioned above, the invention can be applied with advantage to tables whose table tops can be adjusted in inclination. The table top of such a table is, preferably, hinged at its rear edge, and the inclination of the table top can be varied by vertical adjustment of the table top in the area of its forward edge. A table of this type known heretofore was connected with a disadvantage that its table top, which was hinged at its rear edge, was supported at its forward edge so that the trestle always had to be provided with supporting parts reaching right to the forward edge of the table top. However, modern tables of this type used, for example, as desks in offices, often comprise trestles consisting substantially of two side parts with feet and supporting members serving for interconnecting such side parts and being arranged in areas of rear edges of table tops.

The invention provides the particular advantage that it can be implemented also in connection with such trestles. According to a preferred embodiment of a table, whose table top is hinged in the area of its rear edge, the abutment is arranged near the rear edge of the table top. The abutment comprises an oblique surface on which the table top rests in its lowermost position. The table top can then be raised from this lowermost position up to a horizontal position, by inserting the wedge-shaped intermediate piece between the abutment and the table top.

Especially in this embodiment of the invention it may be convenient to arrange the wedge-shaped intermediate piece at an end of a pusher rod mounted on a lower face of the table top and extending to the latter's forward edge. It is then easily possible to lift the table top at its forward edge, for adjusting purposes, and to introduce or withdraw the intermediate piece as required, by actuating the pusher rod. This process may even be facilitated by a spring loaded pusher rod.

According to a preferred embodiment of the invention, the pusher rod is guided in a bearing block mounted on a lower face of the table top. Its end opposite the intermediate piece is provided with a handle, and the rod is surrounded by a spiral compression spring acting between the bearing block and the intermediate piece.

It is a general requirement, in particular with respect to office furniture, that their surface structure and color should be adaptable to existing furniture and equipment. Consequently, it has been general practice to design office tables in such a manner that a standard trestle can be provided with table tops of different kinds. This possibility is provided also for a table according to the invention when, according to a further improvement of the invention, a lower face of the table top is equipped with at least one hollow beam extending perpendicularly to the rear edge of the table top, the abutment projects into the rear end of the hollow beam, and the pusher rod with the intermediate piece are located inside the hollow beam, for movement in the latter's longitudinal direction. The abutment and the hollow beam may be arranged on a corresponding crossbar of the trestle so that different table tops, as desired by the customers, can be fastened to such a hollow beam. Advantageously, the hollow beam may be articulated on the abutment projecting into its rear end.

In the case of tables where the table top comprises a supporting beam extending in parallel to the at least one vertically adjustable edge of the table top, a particularly simple and, at the same time, sturdy design of the adjusting mechanism can be achieved if at least one wedge-shaped intermediate piece is arranged for displacement in the longitudinal direction of the supporting beam, and a wedge-shaped piece complementary to and coacting with the intermediate piece is arranged on the lower face of the table top and provided with a surface which is inclined relative to the table top and which forms a contact surface for a second wedge surface of the intermediate piece. The table top is then supported by a sturdy supporting beam, directly at its vertically adjustable edge, so that the table top is capable of carrying very high loads, without requiring any particular arrangements securing its stability, as required in cases where cantilever arms are used for supporting the table top.

Depending on the length of the table top, the arrangement of a single intermediate piece between the supporting beam and the table top may be sufficient, or several such intermediate pieces may be required. According to a particularly preferred embodiment of the invention, two intermediate pieces are provided in spaced arrangement in the area of the vertically adjustable edge of the table top, each of them coacting with a complementary wedge-shaped piece, and the two of them being interconnected by a pusher rod extending in parallel to the edge of the table top.

In order to securely prevent, even in cases of high loads, that the wedge-shaped intermediate piece may be pressed out from between the abutment and the table top, it may be convenient to provide several discrete locking positions for the wedge-shaped intermediate piece. Such locking positions may be implemented easily in the case of the last-mentioned preferred embodiment of the invention by an arrangement in which the pusher rod interconnecting the intermediate pieces is provided with a radially projecting handle and the supporting beam of the trestle, on which the intermediate pieces are arranged to slide, comprises a plurality of spaced openings into which the handle can be introduced and which define locking positions of the wedge-shaped intermediate pieces.

BRIEF DESCRIPTION OF THE DRAWINGS

The invention will now be described and explained in more detail with reference to embodiments represented in the drawings. The features that can be derived from the following description and the drawings may be used in other embodiments of the invention either individually or in any combination thereof. In the drawing

DESCRIPTION OF PREFERRED EMBODIMENTS

Figure 1:
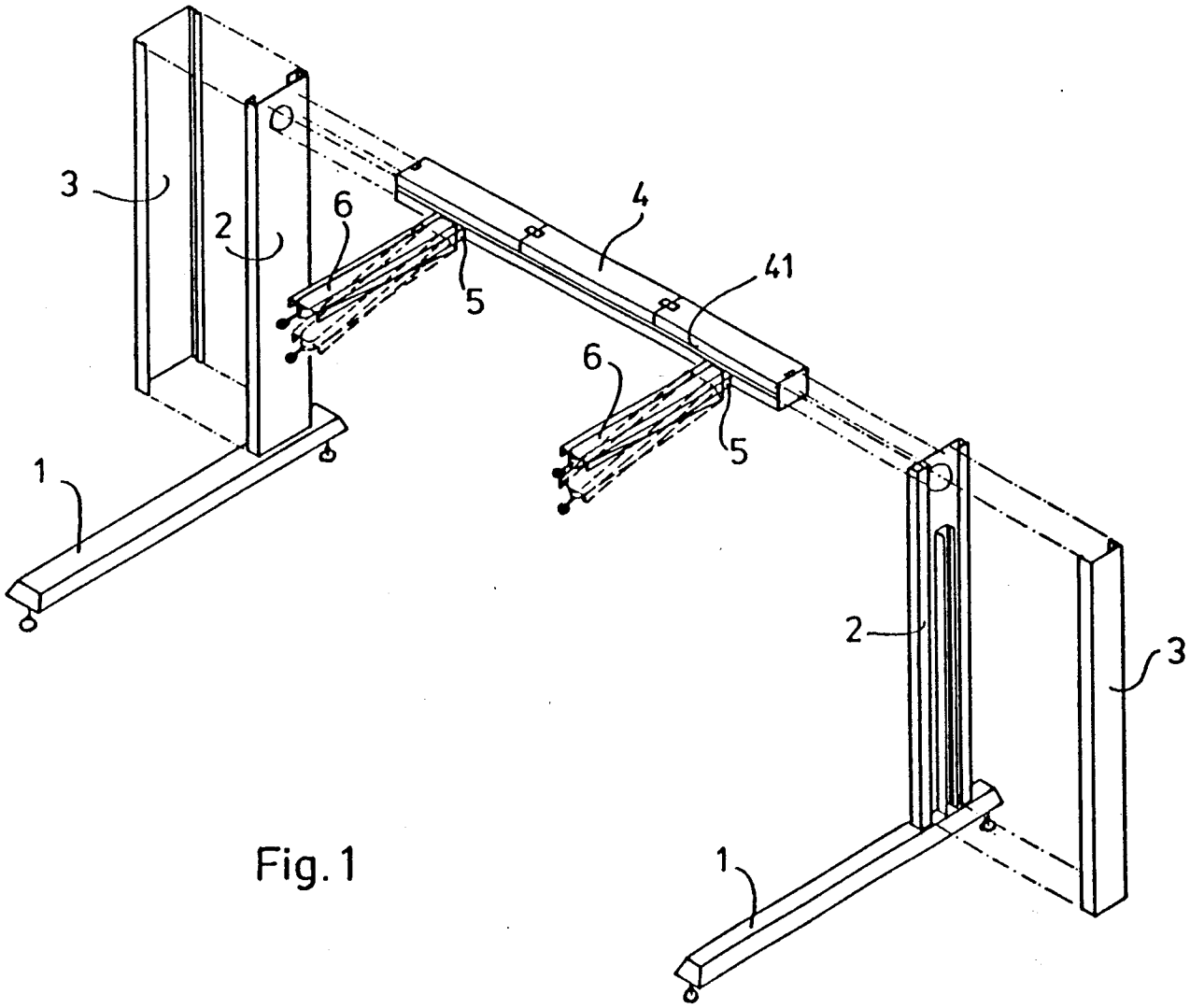
FIG. 1 is an exploded isometric view of the trestle of a table top designed according to the invention.

The trestle represented in FIG. 1 comprises two side parts consisting each of one elongated foot 1 and a column 2 rising from the foot 1 at a point near one of its ends. Each of the columns 2 consists of a channel-like section which is intended for accommodating electric lines, or the like, and which can be closed towards the outside by a cap 3. The two columns 2 are interconnected by a longitudinal beam 4 likewise consisting of a hollow section. The longitudinal beam 4 carries two stops or abutments 5 mounted in spaced arrangement (see also FIG. 2) and carrying in turn hollow beams 6. The hollow beams 6 project substantially horizontally from the longitudinal beam 4, in the same direction in which the feet 1 project beyond the columns 2. They serve for fastening a table top 7, as indicated by dash-dotted lines in FIG. 2.

Figure 2:
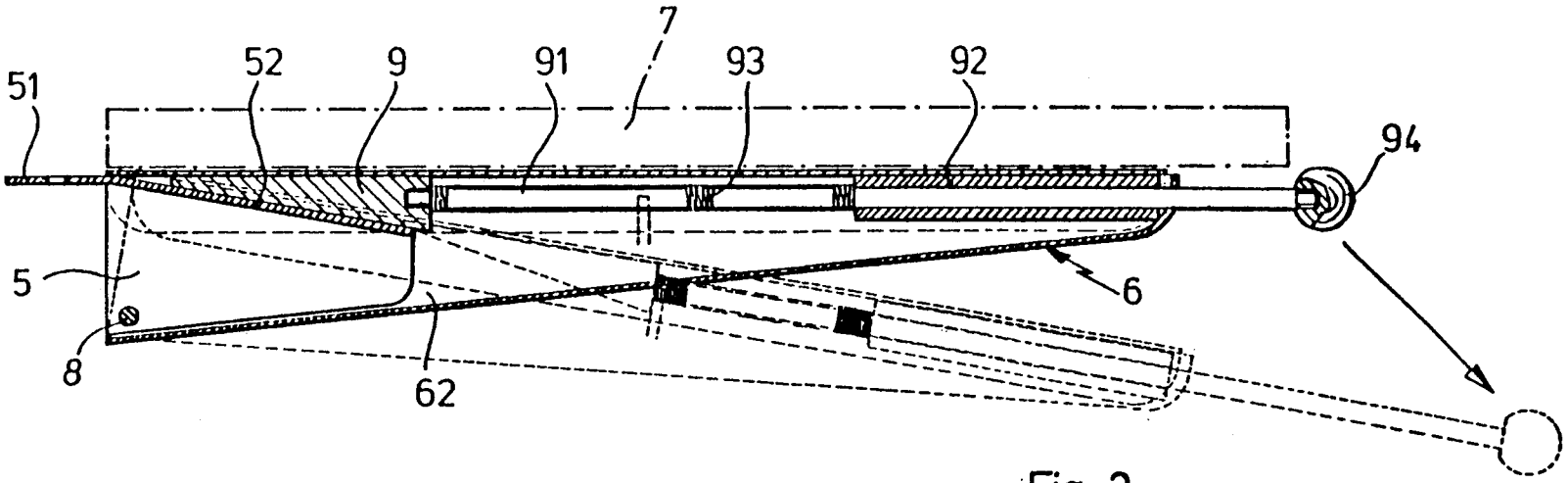
FIG. 2 is a longitudinal sectional view through a hollow supporting beam of the trestle of FIG. 1.
Figure 3:
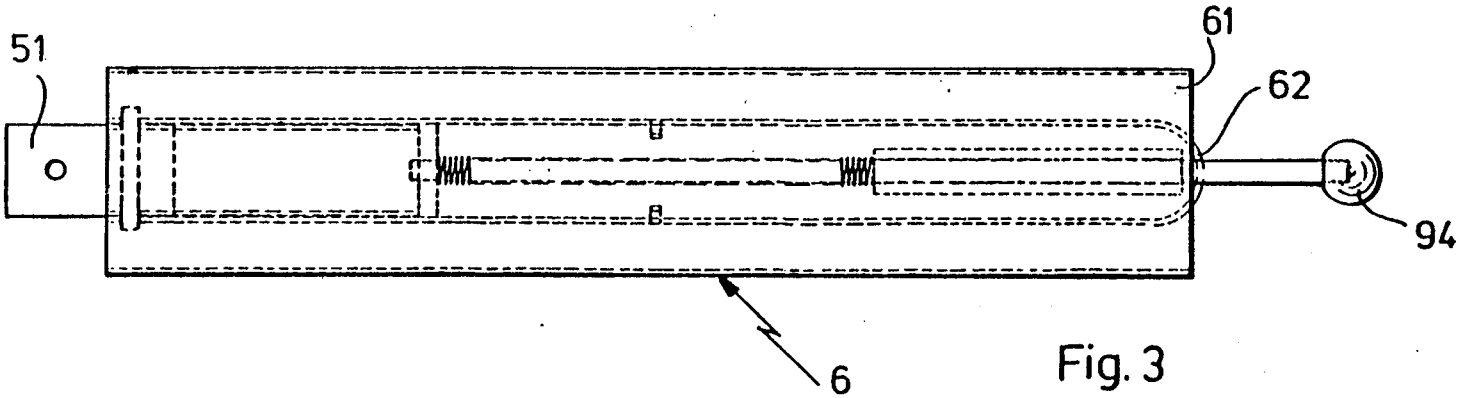
FIG. 3 is a top view of the hollow beam of FIG. 2.
Figure 4:
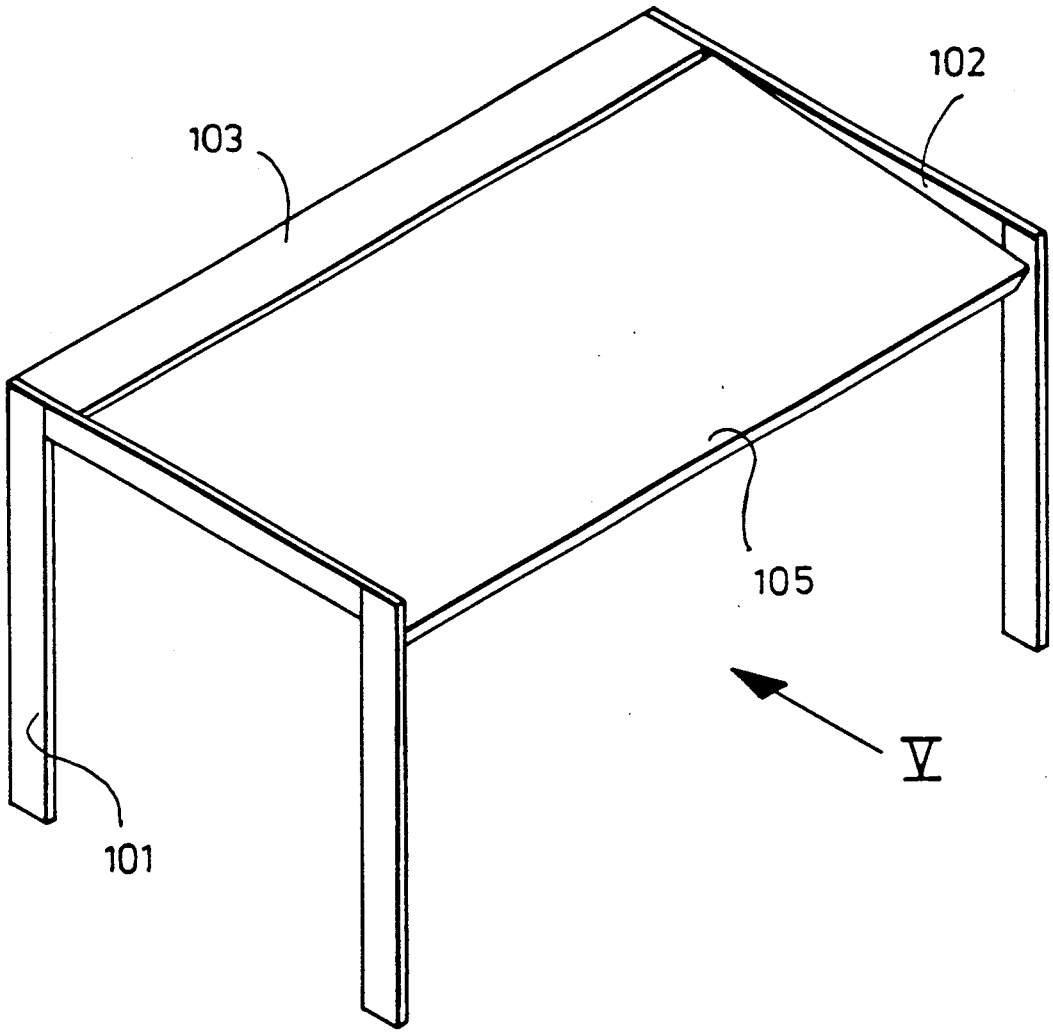
FIG. 4 is an isometric view of another table designed according to the invention.

As can be seen best in FIGS. 2 and 3, the abutments 5 consist of a profiled piece of substantially U-shaped cross-section, which is provided on its one end with a tongue 51 which projects into a slot 41 in the longitudinal beam 4 and is fixed to the latter. The hollow beams 6 are fitted over the abutments 5 and interconnected in articulated relationship by a hinge bolt 8 passed through the lateral sections of the U-shaped profile and the side walls of the hollow beam 6.

Each of the hollow beams 6 comprises an upper plate 61 with sort of a cap 62 fastened to its lower face, the height of the cap 62 decreasing from the end of the hollow beam 6 facing the longitudinal beam 4 towards the other end. Each of the abutments 5 engages the cap 62 of its associated hollow beam. Each of the abutments 5, too, tapers towards the end projecting from the longitudinal beam 4, but to a greater degree than the cap 62, so that the hollow beam 6 can be pivoted by a certain angle relative to the abutment 5, about an axis formed by the hinge bolt 8. In its uppermost position, which corresponds to the horizontal position of the table top 7, the plate 61 of the hollow beam 6 and the crossbar 52 of the abutment 5, which forms a stop face, enclose between them an angle which, in the illustrated embodiment of the invention, is filled by a wedge-shaped intermediate piece 9 defining a wedge angle arranged inside the cap 62. The intermediate piece 9 is mounted at the end of a rod 91 which is supported for displacement in an opening direction of the wedge angle in a bearing block 92 arranged inside the cap 62, on the lower face of the plate 61. The section of the rod 91 located between the bearing block 92 and the wedge-shaped intermediate piece 9 is surrounded by a spiral compression spring 93 tending to retain the intermediate piece 9 in the area between the crossbar 52 of the abutment 5 and the plate 61 carrying the table top 7. The free end of the rod 91 projects from the cap 62, and the projecting end is provided with a knob serving as a handle 94.

It will be readily seen that in the extended position of the hollow beam 6 represented in FIG. 2, the table top is supported by the crossbar 52 of the abutment 5, via the intermediate piece 9, whereby it is safely held in the horizontal position. If, however, the intermediate piece 9 is withdrawn in an opening direction of its wedge angle, from a space between the table top 7 and the abutment 5, by pulling the knob 94, then the hollow beam 6, together with the table top 7, may move downwards into the position indicated by dashed lines in FIG. 2, in which the hollow beam 6, together with its plate 62, rests directly against the stop surface formed by the crossbar 52 of the abutment 5. The inclination of the table top in this position is equal to about 10%. When the table top 7 is to be returned to a higher position, it is only necessary to lift the table top slightly by its forward edge, whereby the wedge-shaped intermediate piece 9 is caused, by action of the spiral compression spring 93, to enter again the space between the abutment 5 and the table top 7 (crossbar 52 and plate 61), as far as this is permitted by the space that has been created by lifting the table top. A force of the spiral compression spring 93 is not sufficient to move the hollow beams 6, with the table top 7, into the horizontal position, beyond a position selected by the lifting movement, while on the other hand a frictional force is developed between the surfaces of the wedge-shaped intermediate piece and the crossbar 52 of the abutment 5 and/or the plate 61 of the hollow beam 6 which is sufficient to prevent the wedge-shaped intermediate piece 9 from being urged outwardly by the weight of the table top 7. It is thus rendered possible, simply by lifting the table top, and without any other measures, to bring the table top into, and to lock it into, any desired position. Similarly, the forward edge of the table top can be lowered with the same ease by a desired amount, by withdrawing the intermediate pieces 9 from the space between the crossbar 52 of the abutment 5 and the table top 7.

A table represented by FIGS. 4 to 7 comprises two side parts 101, 102, which are interconnected by two longitudinal beams 103, 104 to form a sturdy trestle carrying a table top 105 between its side parts 101, 102. A rear edge of the table top 105 adjoins the one longitudinal beam 103 and is articulated thereon in a manner not shown in detail. The articulation can be achieved by means of hinges, or else simply by having the rear edge of the table top 105 supported by a contact surface arranged on the longitudinal beam 103. The other longitudinal beam 104 is located in the forward area of the table top 105, beneath the table top, so that it remains invisible in FIG. 4.

Figure 7:
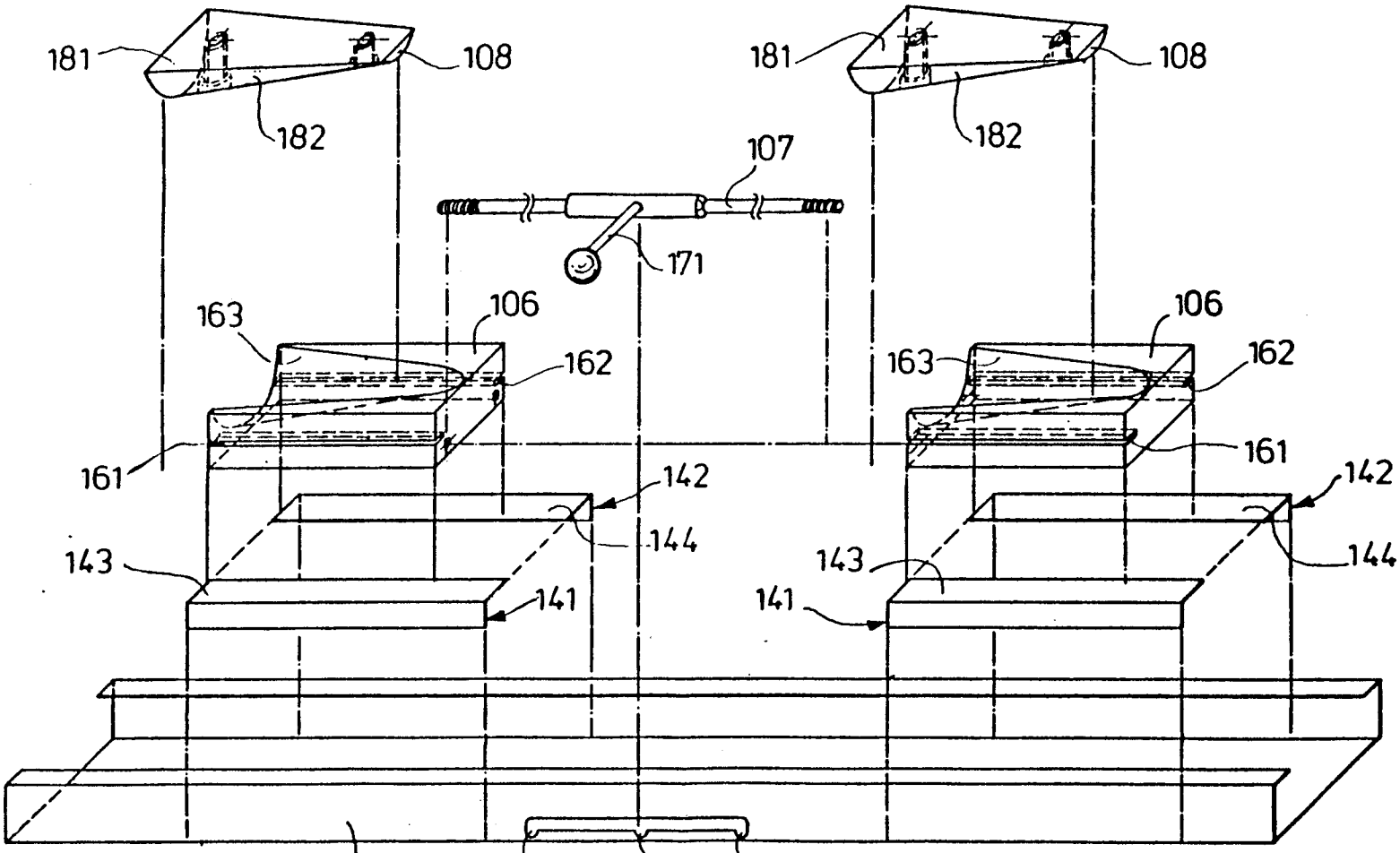
FIG. 7 is an isometric exploded view of the adjusting mechanism of the table of FIG. 4.

As will be seen best in FIG. 7, the beam 104 arranged at the forward edge of the table top 105 takes the form of a hollow profile opening towards the front and accommodating two blocks 106 being part of an adjusting device and arranged therein in sliding relationship. Each of the blocks 106 is supported by two angle rails 141, 142 fixed to the side walls of the hollow beam 104. The webs engage corresponding slots 161, 162 in lateral faces of the blocks 106, thus forming slides for the blocks. The two blocks 106 are interconnected by a pusher rod 107 the central area of which is provided with a radially projecting handle 170 passing through a slot 145 arranged in a sidewall of the beam 104 facing the edge of the table top 105. The slot 145 comprises three openings 146 spaced from each other, into which the handle 171 projecting radially from the pusher rod 107 can be introduced by pivoting the pusher rod. The three openings 146 define discrete locking positions for the block 106 which can be displaced along the beam 104 by means of the pusher rod 107.

The blocks 106 form wedge-shaped intermediate pieces coacting with the wedge pieces 108 mounted on a lower face of the table top 105. Each of these wedge pieces comprises a plane surface 181 which is in contact with the lower face of the table top 105, and an oblique surface 182, which is inclined relative to the table top and which, in the embodiment shown in the drawing, is formed by a circular cylindrical surface whose axis extends obliquely to the plane contact surface 181. The oblique surface 182 extends in parallel to a cylindrical wedge surface 163 formed by a corresponding re ess in the block 106. As can be seen best in FIGS. 5 and 6, the arrangement is such that the oblique surfaces 182 of the wedge pieces 108 mounted on the lower face of the table top 105 rest against the wedge surfaces 163 of the blocks 106. Consequently, the blocks 106 form wedge-shaped intermediate pieces which are guided, in a direction of displacement of the blocks 106, by first wedge surfaces 164 at the bottom of the beam 104 and/or by grooves 161, 162 extending in parallel thereto on angle rails 141, 142 mounted in the beam 104, while the second wedge surfaces 163 serve as contact surfaces for the table top 105, via the wedge pieces 108. Consequently, the table top 105 is supported by the beam 104 via the wedge pieces 108 and the intermediate pieces 106, the position of the intermediate pieces 106 determining the spacing of the table top 105 from the beam 104.

Figure 5:
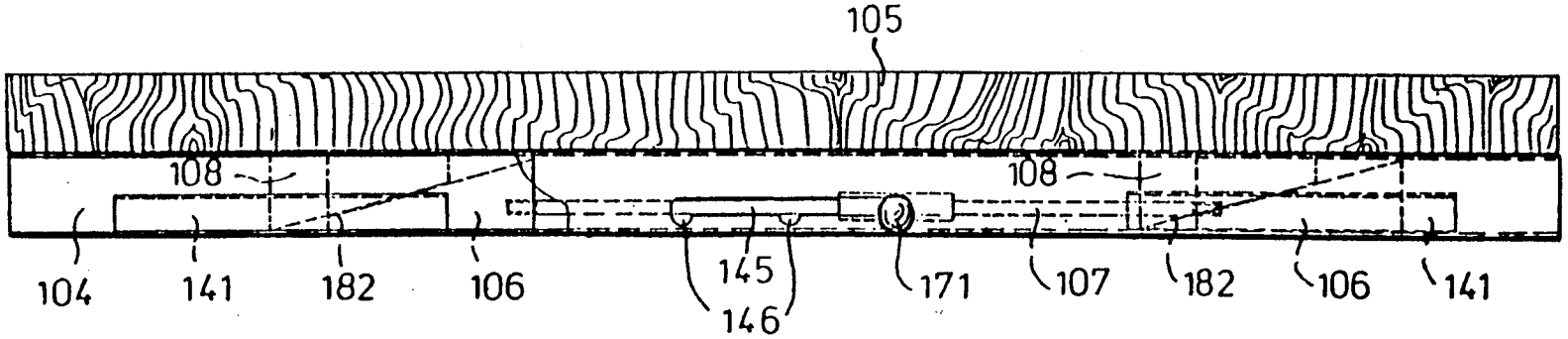
FIG. 5 is an enlarged view taken in the direction of arrow V of FIG. 4 showing the forward edge of a table top and a supporting beam of the table of FIG. 4.
Figure 6:
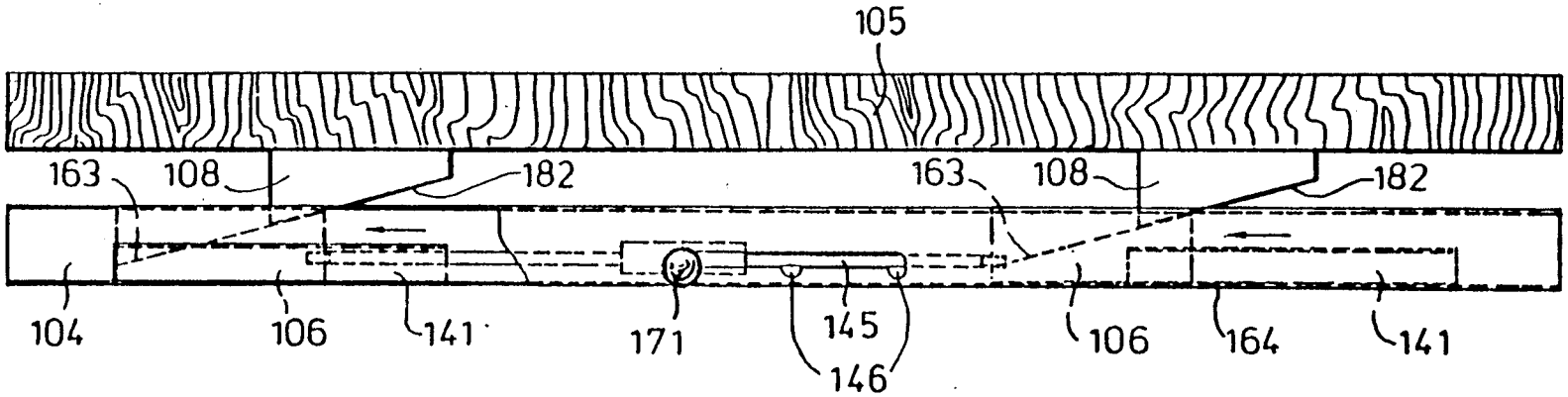
FIG. 6 is a view similar to that of FIG. 5, but with the table top in a raised position.

From FIG. 5 it appears that the intermediate pieces 106 can be displaced to the right—as viewed in the drawing—until the table top 105 comes into direct contact with the upper surface of the beam 104. The table top 105 is raised from this position when the intermediate pieces formed by the blocks 106 are moved to the left by means of the handle 171 mounted on the pusher rod 107. Before the uppermost position shown in FIG. 6 is reached, the handle 107 passes a central opening 146 in the edge of the slot 145, which defines a central locking position for the intermediate pieces 106 and, accordingly, for the table top 105. Of course, a greater number of such locking positions may be provided. And here again, the intermediate pieces can be adjusted without great effort, after lifting the table top by its forward edge, by actuation of the handle 171 and, accordingly, of the pusher rod 107.

It goes without saying that the invention is not limited to the illustrated embodiments, but that deviations therefrom are possible without leaving the scope of the invention. For example, intermediate pieces arranged in the area of the front edge of the table top may also be mounted for displacement in a direction perpendicular to the front edge, and it would also be imaginable to arrange wedge-shaped intermediate pieces on at least two parallel edges of the table top and to interconnect them in such a manner that the table top can be lifted or raised in parallel by simultaneous adjustment of all intermediate pieces. Further, the wedge surfaces of the intermediate pieces and the coacting wedge pieces need not necessarily be straight in the direction of displacement, but might also exhibit fine steps forming sort of a locking mechanism preventing any unwanted displacement of the intermediate pieces. In addition, the adjustable intermediate pieces and/or the associated abutments need not necessarily be arranged on the longitudinal beams of the trestle, but might also be arranged on the latter's side parts. It appears that there are many different modifications available to a man skilled in the art, all of which are within the scope of the invention as defined by the claims.

We claim:

1. Table comprising a trestle, a table top mounted on the trestle and hingedly supported by the trestle, and a device for substantially adjusting the height of only a front edge of the table top relative to the trestle, wherein is further included:

at least one abutment fixed to the trestle beneath the table top;

a movable wedge-shaped intermediate piece having a shape forming a wedge angle, the wedge-shaped intermediate piece coacting with said abutment by being arranged for dispacement in an opening direction of its angle, substantially in parallel to the table top and being introducible to a lesser or greater extent into a space between the abutment and the table top so that a distance between the table top and the abutment and, thus, a position of the front edge of the table top relative to the trestle, are determined by the position of the intermediate piece.

2. Table according to claim 1, wherein said wedge-shaped intermediate piece is mounted at the end of an elongated pusher rod.

3. Table according to claim 2, wherein said pusher rod is supported on a lower face of the table top and extends to the latter's front edge.

4. Table according to claim 3, wherein said pusher rod is guided in a bearing block mounted on the lower face of the said table top, is provided with a handle at its end opposite the intermediate piece, and is surrounded by a spiral compression spring applying a spring force acting between the bearing block and the intermediate piece.

5. Table according to claim 2, wherein said pusher rod is loaded by a spring contacting the intermediate piece and tending to urge the intermediate piece into the space between the said table top and the abutment.

6. Table according to claim 1 wherein said wedge-shaped intermediate piece comprises a first wedge surface extending in parallel to its direction of displacement and a second wedge surface extending at an angle relative to the first surface, and wherein the second wedge surface is in contact with an oblique surface extending in parallel thereto, in at least one defined position of the table top.

7. Table according to claim 6, wherein said second wedge surface and the contacting oblique surface are designed as cylindrical surfaces defined by generating lines extending in parallel to legs of the wedge angle.

8. Table according to claim 7, wherein said second wedge surface and the mating oblique surface are designed as circular cylindrical surfaces of substantially equal radii.

9. Table according to claim 1, wherein said table top is in direct contact with the abutment in its lowermost position.

10. Table according to claim 1 wherein said table top is hinged in an area of its rear edge, and its inclination can be varied by adjusting its height in the area of its front edge.

11. Table according to claim 10, wherein said abutment is arranged near the rear edge of the said table top and comprises an inclined surface which serves as supporting surface for the said table top in its lowermost position.

12. Table according to claim 11, wherein a lower face of the table top is equipped with at least one hollow beam extending perpendicularly to the rear edge of the table top, the abutment projecting into a rear end of the hollow beam, and a pusher rod, with the intermediate piece, being located inside the hollow beam for movement of the intermediate piece in the hollow beam's longitudinal direction.

13. Table according to claim 12, wherein said hollow beam is hingedly attached to and articulated on the abutment projecting into its rear end.

14. Table according to claim 1, wherein said table top comprises a supporting beam extending in parallel to the front edge of the table top, with at least one wedge-shaped intermediate piece being arranged for displacement in a longitudinal direction of the supporting beam, and a wedge-shaped piece complementary to and coacting with the intermediate piece being arranged on a lower face of the table top provided with an oblique surface which is inclined relative to the table top for forming a contact surface for a second wedge surface of the intermediate piece.

15. Table according to claim 14, wherein two intermediate pieces are provided in spaced arrangement in the area of the front edge of the table top, each of them coacting with a complementary wedge-shaped piece, the two of them being interconnected by a pusher rod extending in parallel to the edge of the table top.

16. Table according to claim 15 wherein said pusher rod interconnecting the intermediate pieces is provided with a radially projecting handle and wherein the supporting beam of the trestle, on which the intermediate pieces are arranged to slide, defines a plurality of interconnected spaced openings through which the handle extends and which define locking positions of the wedge-shaped intermediate pieces.

17. Table according to claim 1 wherein several discrete locking positions are provided for the wedge-shaped intermediate piece.

18. Table comprising a trestle, a table top mounted on the trestle and supported movably by the trestle, and a device for adjusting the height of at least one edge of the table top relative to the trestle, wherein is further included:

at least one abutment fixed to the trestle beneath the table top;

a movable wedge-shaped intermediate piece having a shape forming a wedge angle supporting a portion of said table top, the wedge-shaped intermediate piece coacting with said abutment and said portion of said table top by being arranged therebetween for displacement in an opening direction of its angle, substantially in parallel to the table top, the wedge-shaped intermediate member being introducible to a lesser or greater extent into a space between the abutment and the table top so that a distance said wedge-shaped intermediate piece supports the portion of said table top above the abutment and, thus, a position of the table top relative to the trestle, are determined by the position of the intermediate piece, wherein said wedge-shaped intermediate piece is mounted at the end of an elongated pusher rod and wherein said pusher rod is loaded by a spring contacting the intermediate piece and tending to urge the intermediate piece into the space between the table top and the abutment.

19. Table comprising a trestle, a table top mounted on the trestle and supported movably by the trestle, and a device for adjusting the height of at least one edge of the table top relative to the trestle, wherein is further included:

at least one abutment fixed to the trestle beneath the table top;

a movable wedge-shaped intermediate piece having a shape forming a wedge angle supporting a portion of said table top, the wedge-shaped intermediate piece coacting with said abutment and said portion of said table top by being arranged therebetween for displacement in an opening direction of its angle, substantially in parallel to the table top, the wedge-shaped intermediate piece being introducible to a lesser or greater extent into a space between the abutment and the table top so that a distance said wedge-shaped intermediate piece supports the portion of said table top above the abutment and, thus, a position of the table top relative to the trestle, are determined by the position of the intermediate piece, wherein said wedge-shaped intermediate piece comprises a first wedge surface extending in parallel to its direction of displacement and a second wedge surface extending at an angle relative to the first wedge surface, and wherein the second wedge surface is in contact with an oblique surface extending in parallel thereto, in at least one defined position of the table top, and wherein said second wedge surface and the contacting oblique surface are designed as cylindrical surfaces defined by generating lines extending in parallel to legs of the wedge angle.

20. A table according to claim 19, wherein said second wedge surface and the mating oblique surface are designed as circular cylindrical surfaces of substantially equal radii.

21. Table comprising a trestle, a table top mounted on the trestle and supported movably by the trestle, and a device for adjusting the height of at least one edge of the table top relative to the trestle, wherein is further included:

at least one abutment fixed to the trestle beneath the table top;

a movable wedge-shaped intermediate piece having a shape forming a wedge angle supporting a portion of said table top, the wedge-shaped intermediate piece coacting with said abutment and said portion of said table top by being arranged therebetween for displacement in an opening direction of its angle, substantially in parallel to the table top, the wedge-shaped intermediate piece being introducible to a lesser or greater extent into a space between the abutment and the table top so that a distance said wedge-shaped intermediate piece supports the portion of said table top above the abutment and, thus, a position of the table top relative to the trestle, are determined by the position of the intermediate piece, wherein said wedge-shaped intermediate piece is mounted at the end of an elongated pusher rod and wherein said pusher rod is guided in a bearing block mounted on a lower face of the table top, is provided with a handle at its end opposite the intermediate piece, and is surrounded by a spiral compression spring applying a spring force acting between the bearing block and the intermediate piece.

22. Table comprising a trestle; a table top mounted on the trestle and supported movably by the trestle, and a device for adjusting the height of at least one edge of the table top relative to the trestle, wherein is further included:

at least one abutment fixed to the trestle beneath the table top;

a movable wedge-shaped intermediate piece having a shape forming a wedge angle, the wedge-shaped intermediate piece coacting with said abutment by being arranged for displacement in an opening direction of its angle, substantially in parallel to the table top, the wedge-shaped intermediate piece being introducible to a lesser or greater extent into a space between the abutment and the table top so that a distance between the table top and the abutment and, thus, the position of the table top relative to the trestle, are determined by the position of the intermediate piece, wherein said table top is hinged in an area of its rear edge, and its inclination can be varied by adjusting its height in the area of its forward edge, wherein said abutment is arranged near the rear edge of the said table top and comprises an inclined surface which serves as a supporting surface for the said table top in its lowermost position, wherein a lower face of the table top is equipped with at least one hollow beam extending perpendicularly to the rear edge of the table top, the abutment projecting into a rear end of the said hollow beam, and a pusher rod, with the intermediate piece, being located inside the hollow beam for movement of the intermediate piece in the hollow beam's longitudinal direction.

23. A table according to claim 22, wherein said hollow beam is articulated on the abutment projecting into its rear end.

24. Table comprising a trestle, a table top mounted on the trestle and supported movably by the trestle, and a device for adjusting the height of at least one vertically adjustable edge of the table top relative to the trestle, wherein is further included:

at least one abutment fixed to the trestle beneath the table top;

a movable wedge-shaped intermediate piece having a shape forming a wedge angle supporting a portion of said table top, the wedge-shaped intermediate piece coacting with said abutment and said portion of said table top by being arranged therebetween for displacement in an opening direction of its angle, substantially in parallel to the table top, the wedge-shaped intermediate piece being introducible to a lesser or greater extent into a space between the abutment and the table top so that a distance said wedge-shaped intermediate piece supports the portion of said table top above the abutment and, thus, the position of the table top relative to the trestle, are determined by the position of the intermediate piece, wherein said table top comprises a supporting beam extending in parallel to the at least one vertically adjustable edge of the table top, with said wedge-shaped intermediate piece being arranged for displacement in the longitudinal direction of the supporting beam and a wedge-shaped piece complementary to and coacting with the intermediate piece being arranged on a lower face of the table top provided with an oblique surface which is inclined relative to the table top for forming a contact surface for a second wedge surface of the intermediate piece.

25. Table as in claim 24 wherein two intermediate pieces are provided in spaced arrangement in the area of the vertically adjustable edge of the table top, each of them coacting with a complementary wedge-shaped piece, the two of them being interconnected by a pusher rod extending in parallel to the edge of the table top.

26. A table according to claim 25 wherein said pusher rod interconnecting the intermediate pieces is provided with a radially projecting handle and wherein the supporting beam of the trestle, on which the intermediate pieces are arranged to slide, defines a plurality of interconnected spaced openings through which the handle extends and which define locking positions of the wedge-shaped intermediate pieces.

* * * * *